US005493818A

United States Patent [19]

Wilson

[11] Patent Number: 5,493,818

[45] Date of Patent: Feb. 27, 1996

[54] COLLAPSIBLE STRUCTURE HAVING COMPACT SHIPPING PROPERTIES

[76] Inventor: Martin L. Wilson, Rte. 4, Box 950, Orange, Tex. 77630

[21] Appl. No.: 233,938

[22] Filed: Apr. 28, 1994

[51] Int. Cl.[6] ..... E04B 1/346

[52] U.S. Cl. ..... 52/71; 52/79.1; 52/79.5

[58] Field of Search ..... 52/71, 79.1, 79.5

[56] References Cited

U.S. PATENT DOCUMENTS

| | | | |
|---|---|---|---|
| 3,341,987 | 9/1967 | Johansson | 52/71 |
| 3,434,253 | 3/1969 | Hatcher | 52/71 |
| 3,886,676 | 6/1975 | Alfonso | 52/71 |
| 4,742,653 | 5/1988 | Napier et al. | 52/71 |

FOREIGN PATENT DOCUMENTS

| | | | |
|---|---|---|---|
| 2452985 | 5/1975 | Germany | 52/71 |

*Primary Examiner*—Carl D. Friedman
*Assistant Examiner*—W. Glenn Edwards
*Attorney, Agent, or Firm*—Michael I. Kroll

[57] ABSTRACT

The present invention relates to a collapsible structure having improved storage and shipping properties which are achieved by specific designing of the size, shape and hingeable connection positions whereas said structure is erectable and collapsible within minutes utilizing a minimal amount of tools and effort.

4 Claims, 3 Drawing Sheets

COLLAPSIBLE STRUCTURE HAVING COMPACT SHIPPING PROPERTIES

BACKGROUND OF THE INVENTION

1. Field of the Invention

This invention relates to a building structure which is portable and collapsible. The building structure is lightweight and collapsible to a compact shipping and transporting position. This is accomplished by a plurality of hinge assemblies that permit the side and end walls, roof and floor to lie flat upon one another to minimize the size of the building structure in its collapsed position.

2. Description of the Prior Art:

In manufacturing facilities, it is commonplace to protect parts and assemblies during manufacturing from airborne contaminants, such as dust, particles, water, etc., so as to prevent such contaminants from contacting the parts during assembly or during idle downtime. This is particularly important in painting, spraying and coating operations which require extreme cleanliness of the prepared surface before painting, etc., and protection of the painted surface until the paint has completely dried.

To accomplish this, it is common to surround painting and spraying areas in a manufacturing facility with an enclosure to retain airborne paint particles within the enclosure and to prevent other contaminants from contacting the part surfaces. Such enclosures typically incorporate a skeletal framework of spaced, interconnected members to which a number of frame panels, typically rigid members made of steel or other material, are mounted.

While the use of such a building structure is effective at containing the airborne particles within a given area or protecting parts from airborne contaminants, the cost of such a rigid panel enclosure is high especially since long distances must be covered and considerable installation time is required to install the framework in the manufacturing facility and to attach the rigid panels thereto. The high cost of previously devised enclosures has prevented their use over large portions of conveyor lines in manufacturing plants and, thus, the parts are left unprotected after painting, spraying, coating, etc., and between initial surface preparation and painting etc., and are vulnerable to dust, water and other airborne contaminants.

Building structures have also been designed for other applications, such as greenhouses, tents, etc., which use a single, flexible sheet or cover which is placed over and attached to a skeletal framework. This building structure also forms an effective containment shield or barrier surrounding a given area. However, it has been found that it is difficult and time consuming to install a large, single piece cover to a large skeletal framework. This increases installation time and adds to overall manufacturing costs.

Thus, it would be desirable to provide a containment shield which can be installed at the use site in a minimum amount of time. It would also be desirable to provide a contaminant shield which has reduced manufacturing costs. It would also be desirable to provide a contaminant shield which does not require a skeletal framework to be installed at the use site for attachment of rigid frame panels thereto. Finally, it would be desirable to provide a contaminant shield which can be constructed in any configuration for widespread use in many different applications.

The increasing world population (now five billion) has led to housing shortages worldwide. These shortages are also increasing due to the number of people left homeless from natural disasters. Accordingly, there is a need for low cost housing that may be easily transported and assembled where needed, and later disassembled and moved.

While many attempts have been made to provide portable building structures, these structures suffer from numerous disadvantages. Many of these structures are heavy, complex and costly to make, and difficult to assemble and disassemble. In addition, many of these building structures require constant maintenance; for example, wooden structures tend to splinter and constantly need to be waterproofed. Moreover, these building structures tend to corrode due to air pollutants and rust, rot or mildew due to adverse weather conditions. Also, many of the prior art devices require special tools for assembly and disassembly.

Examples of these prior building structures are disclosed in the following U.S. Pat. Nos.: U.S. Pat. No. 617,043 to Phifer; U.S. Pat. No. 1,062,976 to Jackson; U.S. Pat. No. 1,149,213 to Neuberth; U.S. Pat. No. 1,469,525 to Nadolney; U.S. Pat. No. 1,481,142 to Minton et al; U.S. Pat. No. 2,207,836 to Sundell; U.S. Pat. No. 2,591,984 to Walsh; U.S. Pat. No. 3,189,949 to Hurkamp; U.S. Pat. No. 3,341,987 to Johansson; U.S. Pat. No. 3,434,253 to Hatcher; U.S. Pat. No. 3,452,501 to Zimmer et al; U.S. Pat. No. 3,562,973 to Gangemi; U.S. Pat. No. 3,566,554 to Schaffer et al; U.S. Pat. No. 3,781,944 to Gianardi; U.S. Pat. No. 3,984,949 to Wahlquist; U.S. Pat. No. 3,886,676 to Alfonso; U.S. Pat. No. 4,035,964 to Robinson; U.S. Pat. No. 4,166,343 to O'Brian et al; U.S. Pat. No. 4,439,969 to Bartlett; U.S. Pat. No. 4,544,300 to Lew et al; U.S. Pat. No. 4,641,475 to Berridge; U.S. Pat. No. 4,641,985 to Bard et al; U.S. Pat. No. 4,649,684 to Petree et al; U.S. Pat. No. 4,652,170 to Lew; U.S. Pat. No. 4,696,132 to LeBlanc; U.S. Pat. No. 4,726,155 to Nahmias; and U.S. Pat. No. 4,742,653 to Napier et al.

This invention addresses these needs discussed above in the art, along with other needs which will become apparent to those skilled in the art once given this disclosure.

Numerous innovations for a collapsible structure having shipping properties have been provided in the prior art that are described as follows. Even though these innovations may be suitable for the specific individual purposes to which they address, they differ from the present invention as hereinafter contrasted.

U.S. Pat. No. 5,183,427

Collapsible toy building

A. Allen Draper

A toy collapsible house. A column of stacked segments supports the house, held together by a spring tensioned cord, impact triggered release of which slides stiff cord portions away from segment junctions, allowing column and house collapse. The column cord is lifted from above the roof to reassemble the house.

U.S. Pat. No. 4,732,285

Collapsible structure

Heinrich Wuster

A collapsible structure consisting of an umbrella-like clothes drier or of a garden umbrella comprises a central tube and a folding frame, which carries a clothesline or a covering. A flexible sheath is provided, which is adapted to be slipped over the folding frame when it is collapsed. The flexible sheath may be sack-like (closed at one end and open at the other) and in that case may be accommodated in the central tube when the same is open-topped, or in a storage container, which is open-topped and is parallel to and extends beside the central tube. Alternatively the sheath may be tubular (open at both ends) and accommodated in a storage container which concentrically surrounds the lower portion of the central tube. The sack-like sheath can be pulled out of the central tube or the juxtaposed storage container at its top end and over an upwardly convex, annular guiding hood and can then be slipped from above over the collapsed folding frame. The tubular sheath can be pulled out of the open top of the concentric storage container and can be slipped from below over the collapsed folding frame. A rope or a spring, which is secured in the juxtaposed storage container or to the central tube on the inside thereof, is secured to the sack-like sheath and can be used to retract the sheath into the central tube of the juxtaposed storage container.

U.S. Pat. No. 4,754,774

Collapsible shelter

Ashley Leader

A collapsible structure adapted to be mounted on a supporting base such as a motor vehicle. The collapsible structure includes a roller journalled on a supporting structure and to which one end of a flexible roof panel is secured for rolling and unrolling. A supporting structure including a frame comprising a pair of transversely spaced tracks provide a guide for supporting guide members carried at the ends of the roof panel for assisting in its rolling and unrolling operation.

U.S. Pat. No. 4,696,132

Foldable shelter system and method of construction

J. T. LeBlanc

A habitable shelter and method of construction having a continuous floor portion with a plurality of four exterior walls attached to the floor portion via a hinge means along contiguous sides, the walls movable between horizontal positions along the floor to vertical upright wall positions. There is further provided means for allowing the walls to lay parallel to the floor, with the end walls foldable atop the side walls, and a plurality of exterior walls stacked between the folded end walls for compact storage for shipment. There is further provided a plurality of corner beam members for stabilizing the walls in their upright position in interlocking fashion, and a roof member positioned atop the vertical walls for defining an angulated roof on the structure. There is further provided a plurality of interior walls which in their upright position are doweled into the floor portion and interlocked into the side walls for further support.

5,107,639

Portable and collapsible building structure

J. Cecil Morin, and James A. Loggie

A portable and collapsible building structure including a floor, a pair of side walls, a roof and a pair of end walls. The side walls each include a lower and upper panel pivotally coupled at their inner edges by a first hinge assembly. The outer edges of the side walls are pivotally coupled to the floor and roof by a second hinge assembly. The end walls are pivotally coupled to the roof by a third hinge assembly and releasably coupled to the floor and side walls by a C-shaped coupling chip. The first, second and third hinge assemblies permit the building structure to collapse so that the upper and lower panels of each side wall lie substantially flat between the floor and the roof, while the end walls pivot 270 degree. So as to lie substantially flat upon the roof. The first, second and third hinge assemblies include a plurality of one-piece, extruded, coupling channels, a plurality of hinge inserts, at least one hinge pin, and a C-shaped coupling clip.

U.S. Pat. No. 4,860,778

Contaminant shield and method of constructing same

Ronald R. Pohl

A contaminant shield prevents airborne contaminants from contacting manufactured parts in a work area in a manufacturing facility. The contaminant shield is formed of a plurality of like frames, each formed of a plurality of interconnected side frame members covered by a flexible sheet attached at its outer edges to the side frame members. The frames are interconnected at adjacent edges to form the complete contaminant shield. A sealing strip is applied to the joints between adjacent frames to form a continuous contaminant barrier in conjunction with the flexible sheet attached to each frame. The contaminant shield is constructed by first constructing a plurality of frames by interconnecting side frame members into a rigid, planar frame and attaching the edges of a flexible sheet to each side frame member of the frame. Each of the side frame members includes an aperture which receives a complimentrally shaped cap which traps the edges of the flexible sheet between itself and the aperture in the side frame for securely attaching the flexible sheet to the side frame.

Numerous innovations for a collapsible structure having shipping properties have been provided in the prior art that are adapted to be used. Even though these innovations may be suitable for the specific individual purposes to which they address, they would not be suitable for the purposes of the present invention as heretofore described.

SUMMARY OF THE INVENTION

The collapsible structure having shipping properties of the present invention is formed of a plurality of frames of a configuration which are interconnected in a predetermined configuration to surround or cover an area. The frames are formed of a plurality of hinged end, side and roof frame members which are joined together into an integal, planar assembly having a predetermined shape. The side frame members surround an interior opening.

A plurality of such frames, having the same or different configuration are interconnected together to form a collapsible structure having shipping properties having any desired shape. For example, a plurality of frame members may be interconnected to form a three-sided floor-mounted enclosure having opposed side walls joined together by a top. Similarly, the frame members may be joined together to form an elongated planar cover having depending side walls which covers a work area in a manufacturing facility.

In one embodiment, means for attaching the edges of a flexible sheet to the side frame members of a frame are provided. Preferably, the attaching means comprises each side frame member having opposed side walls joined together at one end by an integral, central portion. The opposite ends of the side walls are each formed with an inwardly and downwardly hinge, with the inner faces of the hinge being spaced apart to define an aperture opening into the hollow interior of each side frame member. A member has first and second end portions, with the first end portion being complimentary shaped to the configuration of the aperture in the side frame members. The second end portion of the member has an enlarged cross section with hinge extending outward from the first end portion. The first end portion of a member is inserted into the aperture in a side frame member to trap an edge of the sheet between first end portion and the side frame member to securely attach the sheet to the side frame member. Members are inserted into the remaining side frame members of a frame to securely attach the sheet to the frame.

After the collapsible structure having shipping properties are constructed at the manufacturing facility, they are shipped to the use site and arranged to be formed having a predetermined configuration. After the frames are joined together as described above to form an enclosure, shield, cover, etc., the joints between adjacent side frame members of adjacent frames are sealed by a hinge, for example, to provide a continuous, protrusion free surface in conjunction with the sheet which provides no dust collection surfaces within or under the contaminant shield and effectively blocks the interior space enclosed or covered by the contaminant shield from airborne contaminants, such as particles, dust, water, etc.

In a preferred embodiment, each of the side frame members has opposed side walls interconnected by a central portion. In attaching the sheet to the frame according to the method of the present invention, the sheet is first loosely placed over one entire side of the frame covering all of the side frame members. Tension is applied to one edge of the sheet while the cap member is slidably inserted into one of the side frame members trapping the edge of the sheet between itself and the side frame member.

The collapsible structure having shipping properties of the present invention provides many unique advantages in constructing collapsible structure having shipping properties or barriers for manufacturing facilities since it minimizes installation time and has a reduced manufacturing cost. By constructing the individual frames at the frame manufacturing site, the need for constructing and installing a skeletal frame at the use site is eliminated. This reduces installation time. Also, the advantages of mass production of identical or nearly identical frames is attained thereby reducing the overall manufacturing cost of the collapsible structure having shipping properties. Since the collapsible structure having shipping properties of the present invention finds advantageous use with conveyor lines or other elongated work areas, the collapsible structure having shipping properties will contain a large number of identical frames thereby enabling the economies of mass production of the identical modular frames at the frame manufacturing site to be realized.

The collapsible structure having shipping properties of the present invention, once installed at the use site, provides an effective barrier which prevents airborne contaminants, such as dust, particles, water etc., from contacting work parts or assemblies in a given area within a manufacturing facility.

Accordingly, a primary object of the present invention is to provide a building structure which is readily and easily assembled and disassembled without the need of any tools.

Another object of the present invention is to provide a collapsible structure having shipping properties that is portable.

Still another object of the present invention is to provide a collapsible structure having shipping properties that is lightweight and very strong.

Yet another object of the present invention is to provide a collapsible structure having shipping properties that is very compact so that it can be easily transported.

Yet another object of the present invention is to provide a collapsible structure having shipping properties that has very low maintenance.

Yet another object of the present invention is to provide a collapsible structure having shipping properties that will not rust, rot or mildew and is highly resistant to most weather conditions.

Yet another object of the present invention is to provide a collapsible structure having shipping properties that is relatively inexpensive to manufacture and uses a series of extruded channels to form the required hinges.

Yet another object of the present invention is to provide hinge assemblies that require relatively no assembly.

Other objects, advantages and salient features of the present invention will become apparent from the following detailed description, which, taken in conjunction with the annexed drawings, discloses a preferred embodiment of the present invention.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing.

LIST OF REFERENCE NUMERALS UTILIZED IN THE DRAWING

10—collapsible structure having improved shipping and storing properties
12—hinge
14—front end
16—door
18—front end edge
20—piano hinge
22—downward direction
24—right roof
26—right upper side
28—right lower side
30—rear end
32—floor
34—left roof
36—left upper side
38—left lower side
40—left inward direction
42—right inward direction
44—inward collapsible direction
46—front door
48—downward collapsible direction

DETAILED DESCRIPTION OF THE PREFERRED EMBODIMENT

Figure 1:
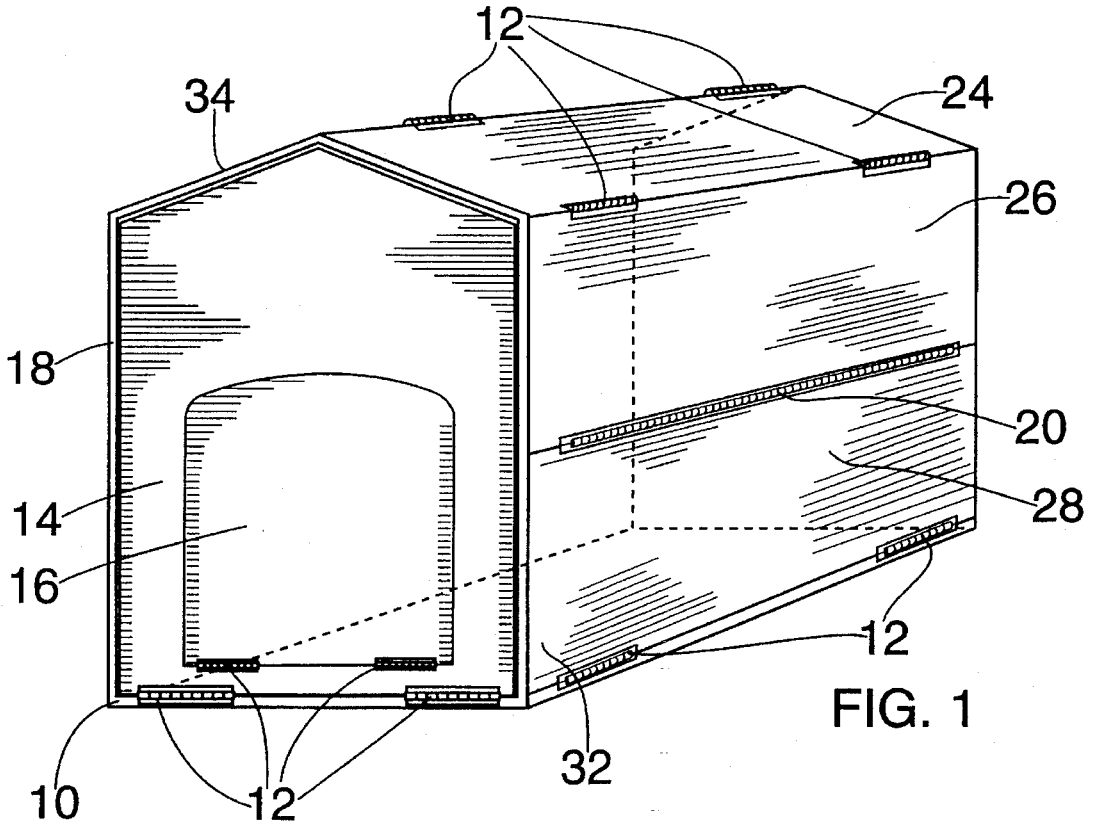
FIG.1 is a perspective view of the collapsible structure having improved shipping and storing properties fully erected exhibiting the following features; hinge, front end, door, front end edge, piano hinge, right roof, right upper side, right lower side, floor, and left roof.

Firstly, referring to FIG. 1 which is a perspective view of the collapsible structure having improved shipping and storing properties 10 fully erected exhibiting the following features; hinge 12, front end 14, door 16, front end edge 18, piano hinge 20, right roof 24, right upper side 26, right lower side 28, floor 32, and left roof 34. The collapsible structure 10 is easily assembled and disassembled in minutes by the method as exhibited in FIGS. 2,3 and 4.

Figure 2:
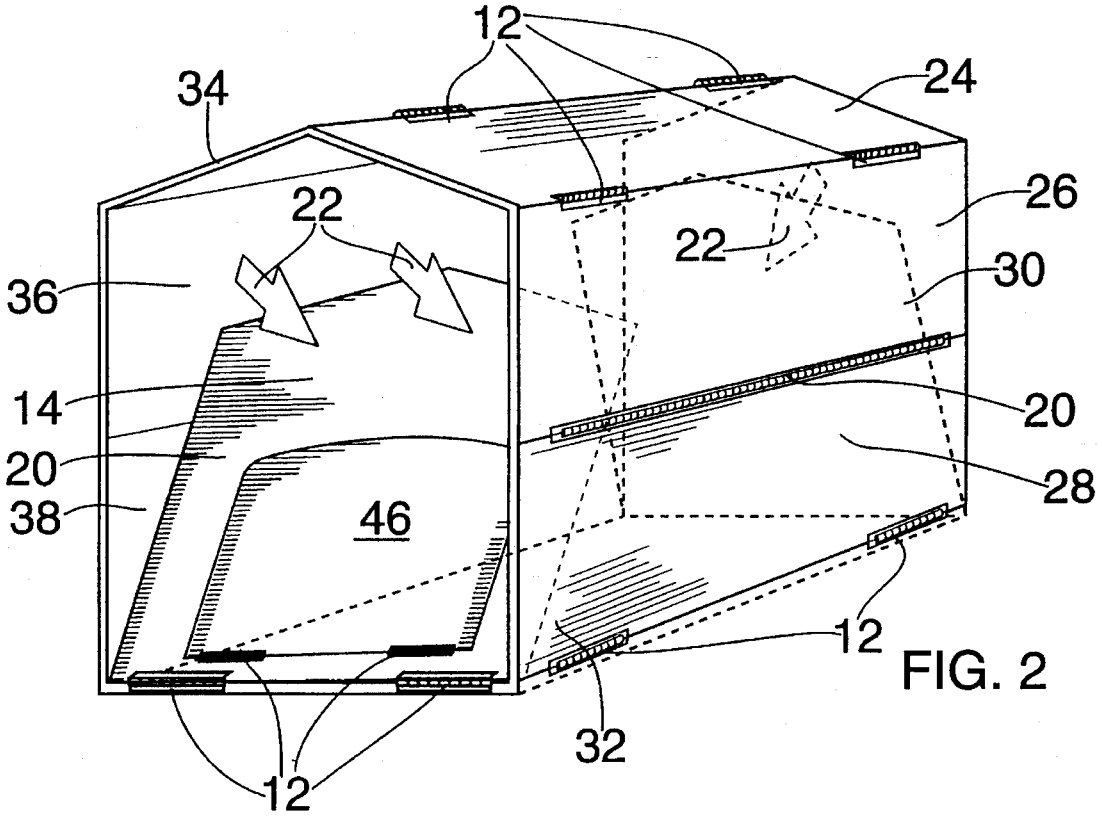
FIG. 2 is a perspective view of the collapsible structure in the initiation collapsing stage having improved shipping and storing properties exhibiting the following features; hinge, front end, door, front end edge, piano hinge, downward direction, right roof, right upper side, right lower side, rear end, floor, left roof, left upper side, left lower side, and front door.

Referring now to FIG. 2 which is a perspective view of the collapsible structure 10 in the initiation collapsing stage having improved shipping and storing properties exhibiting the following features; hinge 12, front end 14, door 16, front end edge 18, piano hinge 20, downward direction 22, right roof 24, right upper side 26, right lower side 28, rear end 30, floor 32, left roof 34, left lapper side 36, left lower side 38, and door opening 46. To commence the collapsing of the structure 10, first push the front end 14 in a downward direction 22 followed by pushing secondly the rear end 30 in a similar downward direction 22, thus collapsing the front end 16 and/or rear end 30 on top of one another.

Figure 3:
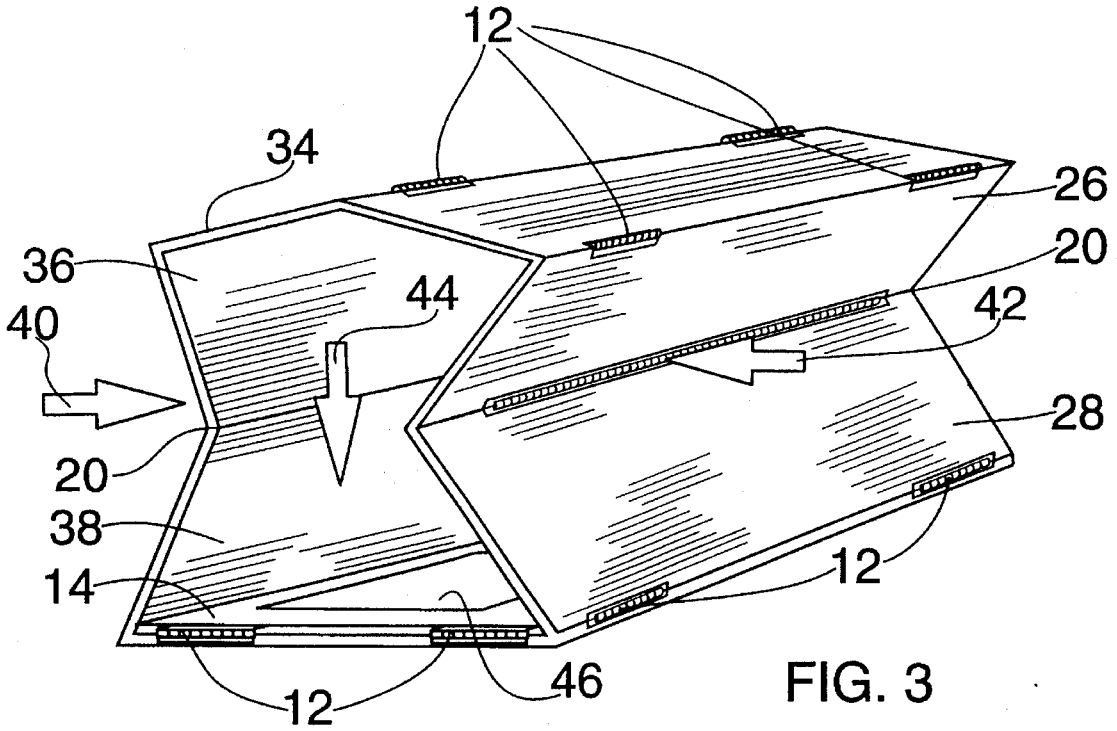
FIG. 3 is a perspective view of a collapsible structure in the collapsing stage having improved shipping and storing properties exhibiting features such as a hinge, front end, piano hinge, downward direction, right roof, right upper side, right lower side, left roof, left upper side, left lower side, left inward direction, right inward direction, inward collapsible direction, and front door.
Figure 5:
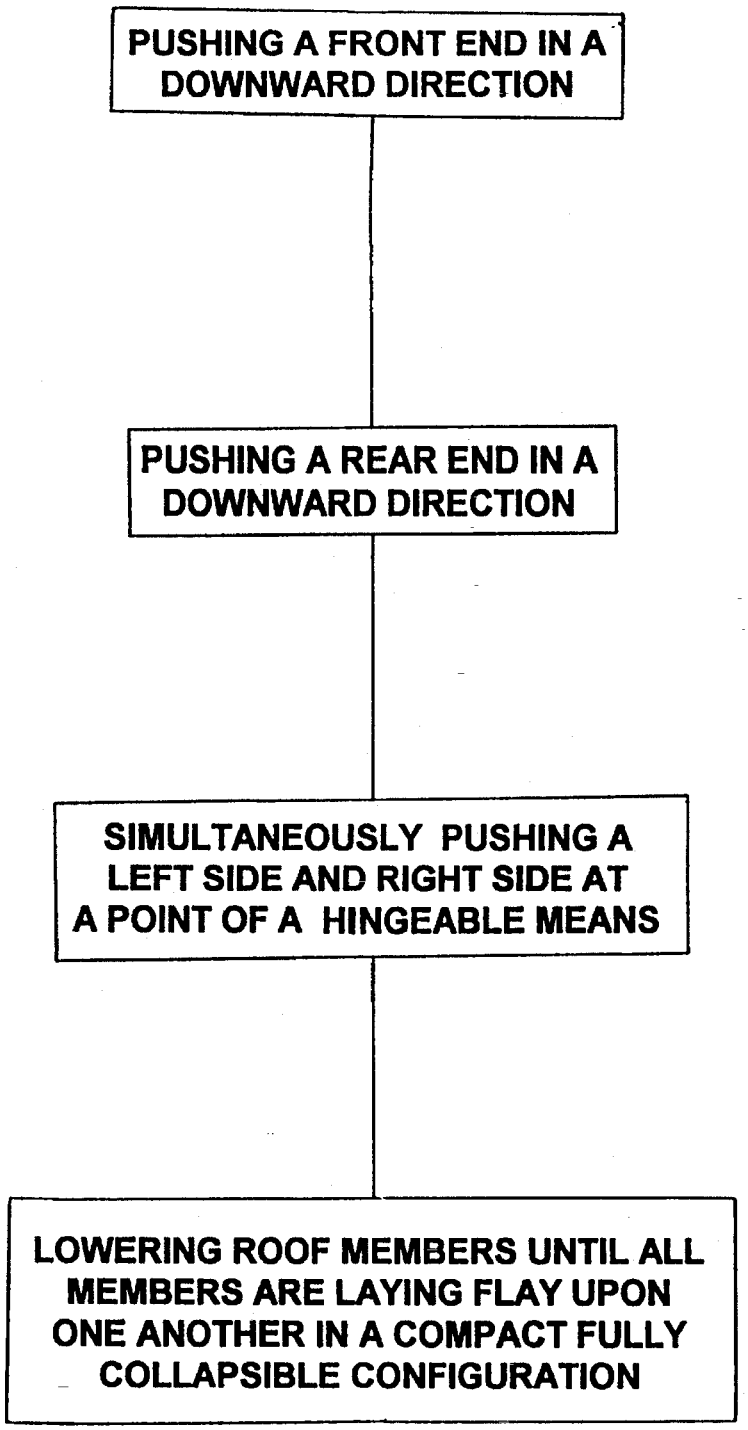
FIG. 5 is a diagrammatic representation of the method by which the structure is erected and collapsed.

Referring now to FIG. 3 and FIG. 5 which are a perspective view of a collapsible structure 10 and a method of collapsing, respectively, in the collapsing stage having improved shipping and storing properties exhibiting features such as a hinge 12, front end 14, piano hinge 20, downward direction 22, right roof 24, right upper side 26, right lower side 28, left roof 30, left upper side 36, left lower side 38, left inward direction 40, right inward direction 42, inward collapsible direction 44, and door opening 46. After the front end 16 and rear end 30 have been fully collapsed, the third step is simultaneously collapsing the left side and right side in a left inward direction 40 and right inward direction 42 respectively, hence, lowering the left roof 34 and right roof 24.

Figure 4:
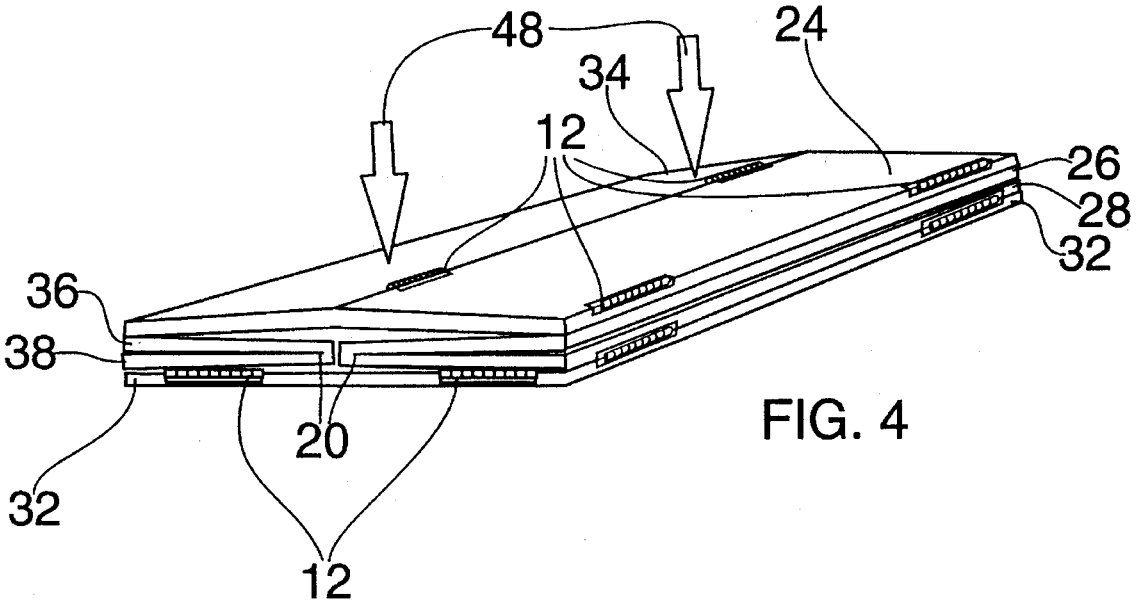
FIG. 4 is a perspective view of a collapsible structure in the fully collapsed configuration for storing and shipping exhibiting the following features; hinge, piano hinge, right roof, right upper side, right lower side, floor, left roof, left upper side, left lower side, and downward collapsible direction.

Lastly, referring to FIG. 4 and which is a perspective view of a collapsible structure 10 in the fully collapsed configuration for storing and shipping exhibiting the following features; hinge 12, piano hinge 20, right roof 24, right upper side 26, right lower side 28, floor 32, left roof 34, left upper side 36, left lower side 38, and downward collapsible direction 48. When the collapsible structure 10 is fully collapsed, it is in a compact configuration having the right roof 24 directly on top of the right upper side 26 which is directly on top of the right lower side 28 which is directly on top of one half of the front end 14 and rear end 30 which are directly on top of one half of the floor 32. Similarly, when the collapsible structure 10 is fully collapsed, it is in a compact configuration having the left roof 34 directly on top of the left upper side 36 which is directly on top of the left lower side 38 which is directly on top of one half of the front end 14 and rear end 30 which are directly on top of one half of the floor 32. All parts of the collapsible structure are collapsible by virtue of hinges 12 and 20 which may be of varying configurations and types depending upon varying preferred embodiments of the present invention.

It will be understood that each of the elements described above, or two or more together, may also find a useful application in other types of constructions differing from the type described above.

While the invention has been illustrated and described as embodied in a collapsible structure having improved shipping and storage properties, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A collapsible housing structure having improved shipping and storage properties comprising:

a. a floor, two side walls, two end walls, and a roof having hinge means along the ridge thereof located along a line extending longitudinally midway of the floor forming two substantially identical halves of said roof permitting the two halves of said roof to open outwardly permitting said ridge to move downwardly to form a flat configuration;

b. means hingeably connecting the outer edges of said roof parallel to said ridge to said two side walls, respectively, permitting said roof halves to fold inwardly with respect to said side walls;

c. means hingeably connecting the bottom edges of said two side walls parallel to said ridge to said floor to permit said side walls to fold inwardly;

d. means for hingeably connecting said two end walls to said floor to permit said end walls to be folded down inwardly against said floor; and e. each of said side walls being divided into two substantially equal halves along a parting line parallel to the ridge of said roof and including hinge means mounted along said parting line joining the two halves of each of said side walls to permit each said side wall to fold inwardly so that each of said halves lies flat on top of said end walls folded down against said floor, said roof folding down flat against said folded side walls, thereby forming a relatively flat, compact unit suitable for shipping and storage.

2. A collapsible structure having improved shipping and storage properties as described in claim 1, whereas said front end having a door contained therein.

3. A collapsible structure having improved shipping and storage properties as described in claim 1, whereas said hinge means on each of said side walls is a piano hinge, and one of said end walls having a door hinged near the lower end of said one end wall.

4. A collapsible structure having improved shipping and storage properties as described in claim 1, whereas said structure is constructed from a material selected from the group consisting of wood, plastic, plastic composites, metal, metal alloys, fiberglass, epoxy, carbon graphite, ceramic, petroleum derivatives, and glass.

* * * * *